US008087883B2

(12) United States Patent
Bouru et al.

(10) Patent No.: US 8,087,883 B2
(45) Date of Patent: Jan. 3, 2012

(54) CYLINDRICAL-ROD DEVICE FOR CONTROLLING A VARIABLE-PITCH VANE OF A TURBOMACHINE

(75) Inventors: Michel Andre Bouru, Montereau sur le Jard (FR); Andre Remi Claude Verbrugge, Combs la Ville (FR)

(73) Assignee: Snecma, Paris (FR)

( * ) Notice: Subject to any disclaimer, the term of this patent is extended or adjusted under 35 U.S.C. 154(b) by 1175 days.

(21) Appl. No.: 11/780,736

(22) Filed: Jul. 20, 2007

(65) Prior Publication Data

US 2008/0031729 A1 Feb. 7, 2008

(30) Foreign Application Priority Data

Aug. 2, 2006 (FR) ..... 06 53250

(51) Int. Cl.
*F04D 29/56* (2006.01)

(52) U.S. Cl. ..... 415/160

(58) Field of Classification Search ..... 415/148, 415/160–166

See application file for complete search history.

(56) References Cited

U.S. PATENT DOCUMENTS

| | | | | |
|---|---|---|---|---|
| 3,706,437 | A * | 12/1972 | Eberhardt | 248/230.4 |
| 3,887,297 | A * | 6/1975 | Welchek | 415/161 |
| 5,545,166 | A * | 8/1996 | Howland | 606/264 |
| 7,850,719 | B2 * | 12/2010 | Gournay et al. | 606/278 |

FOREIGN PATENT DOCUMENTS

| | | | |
|---|---|---|---|
| DE | 198 16 645 | A1 | 10/1999 |
| EP | 1 331 403 | A1 | 7/2003 |
| EP | 1 669 548 | A1 | 6/2006 |
| FR | 2 698 405 | A1 | 5/1994 |
| FR | 2 879 684 | A1 | 6/2006 |
| FR | 2 879 688 | A1 | 6/2006 |

* cited by examiner

*Primary Examiner* — Edward Look
*Assistant Examiner* — Sean J Younger
(74) *Attorney, Agent, or Firm* — Oblon, Spivak, McClelland, Maier & Neustadt, L.L.P.

(57) ABSTRACT

A variable-pitch control device for a turbomachine compressor is disclosed. The device includes a rod, a fastening device for fastening a first end of the rod to a pivot of a vane to be controlled, and a connection device between a second end of the rod and a control ring. The rod is substantially cylindrical, its first end being engaged in a bore in the pivot of the vane. The device further includes a clamping device for clamping the first end of the rod in the bore in the pivot in order to fasten it to the pivot.

13 Claims, 6 Drawing Sheets

CYLINDRICAL-ROD DEVICE FOR CONTROLLING A VARIABLE-PITCH VANE OF A TURBOMACHINE

BACKGROUND OF THE INVENTION

The present invention relates to the general field of controlling variable-pitch vanes. A particular application lies in the field of aviation, and in particular to controlling the angular positions of vanes directing air flow into turbomachine compressors.

Known devices for controlling variable-pitch vanes in a turbomachine usually comprise a control member in the form of a ring surrounding a casing of the turbomachine and a plurality of levers or rods, each rod having a first end connected to the control ring via a hinge and a second end mounted on the pivot of a respective vane. Synchronized modification of the angular position of the vanes is achieved by turning the ring around the axis of the turbomachine.

In order to be able to follow the turning movement of the ring, the connection between each rod and the ring includes at least one degree of freedom in rotation about an axis extending substantially radially relative to the ring. Nevertheless, since the rod is rigidly mounted on the corresponding vane pivot, turning the ring leads to other relative movements between the ring and the portion of the rod mounted on the vane pivot.

In order to accommodate these additional movements, or at least some of them, it is well known to make the connection in the form of a ball joint or the like. The mechanical hinge between the vane pivot and the end of the rod mounted thereon can be achieved in various ways. For example, the vane pivot may have a threaded end passing through an orifice pierced in the control rod, a nut tightened onto the threaded end of the pivot serving to cause these two parts to turn together once their angular position has been set.

Thus, hinges are known in which the control rod is driven using a drive square without taking up slack. In that prior art, the lack of accuracy in control rod turning relative to the vane pivot lies in the range 0.5° to 0.7° (because of manufacturing tolerances). This lack of accuracy in positioning the rod is particularly harmful to good operation of the assembly as a whole).

OBJECT AND SUMMARY OF THE INVENTION

A main object of the present invention is thus to mitigate such drawbacks by proposing a variable-pitch vane control device that enables the rod to be held without slack on the pivot of the vane to be controlled so as to eliminate inaccuracy in positioning, without requiring additional parts to be added.

This object is achieved by a device for controlling a variable-pitch vane for a turbomachine compressor, the device comprising a rod, means for fastening a first end of the rod on a pivot of a vane to be controlled, and connection means between a second end of the rod and a control ring, in which device, in accordance with the invention, the rod is substantially cylindrical in shape, in that the first end of the rod is engaged in a bore in the pivot of the vane, and the device further includes clamping means for clamping the first end of the rod in the bore in the pivot in order to fasten the rod to the pivot.

This type of control device presents numerous advantages. In particular, it eliminates the slack in the initial connection resulting from the manufacturing tolerances applicable to the component parts of the assembly, and it does so with a minimal number of parts. Any inaccuracy in positioning is thus eliminated. Furthermore, a rod of substantially cylindrical shape as used in the device of the invention is completely rigid along its entire length, does not suffer any twisting movement, and is easy to make, thereby contributing to increasing its lifetime and reducing its manufacturing cost. Finally, since such a device presents very few parts, it is easy to assemble.

In an embodiment of the invention, the clamping means exert clamping in a direction that is substantially perpendicular to the longitudinal axis of the rod.

Under such circumstances, the device preferably includes a slot formed in the pivot of the vane in a plane containing the longitudinal axis of the rod and lying in the middle of the pivot, an orifice formed through the pivot of the vane in a direction substantially perpendicular to the plane of the slot, and a screw mounted in the orifice of the pivot and clamped by a clamping nut so as to clamp said slot.

The first end of the rod may include an indentation for co-operating with a cylindrical portion of the body of the screw when the screw is mounted in the orifice in the pivot of the vane so as to provide additional blocking of the rod on the pivot.

The pivot of the vane may present a substantially plane shoulder for co-operating with a flat of the head of the screw when the screw is mounted in the orifice in the pivot of the vane so as to prevent the screw from turning in the orifice in the pivot.

In another embodiment of the invention, the clamping means exert clamping in a direction that is substantially parallel to the longitudinal axis of the rod.

Under such circumstances, and advantageously, the first end of the rod is threaded and the bore in the pivot of the vane presents two end portions that are substantially frustoconical in shape opening to the outside of the pivot, the end portions being interconnected by a substantially cylindrical central portion.

The first end of the rod may include a collar having a conical bearing surface co-operating with one of the end portions of the bore in the pivot of the vane, and the device may further comprise a clamping part of substantially frustoconical shape mounted around the first end of the rod and co-operating with the other end portion of the bore in the pivot, said clamping part having longitudinal slots; and a clamping nut screwed onto the first end of the rod and tightened against the clamping part.

Alternatively, the first end of the rod may include a collar forming a longitudinal abutment, and the device may further comprise: a first clamping part of substantially frustoconical shape mounted around the first end of the rod in abutment against the collar and co-operating with one of the end portions of the bore in the pivot of the vane; a second clamping part of substantially frustoconical shape mounted around the first end of the rod and co-operating with the other end portion of the bore in the pivot of the vane, the clamping parts each having longitudinal slots; and a clamping nut screwed onto the first end of the rod and tightened against the second clamping part.

The invention also provides a compressor and a turbomachine including at least one variable-pitch vane control device as defined above.

BRIEF DESCRIPTION OF THE DRAWINGS

Other characteristics and advantages of the present invention appear from the following description given with reference to the accompanying drawing an embodiment having no limiting character. In the figures.

DETAILED DESCRIPTION OF AN EMBODIMENT

Figure 1:
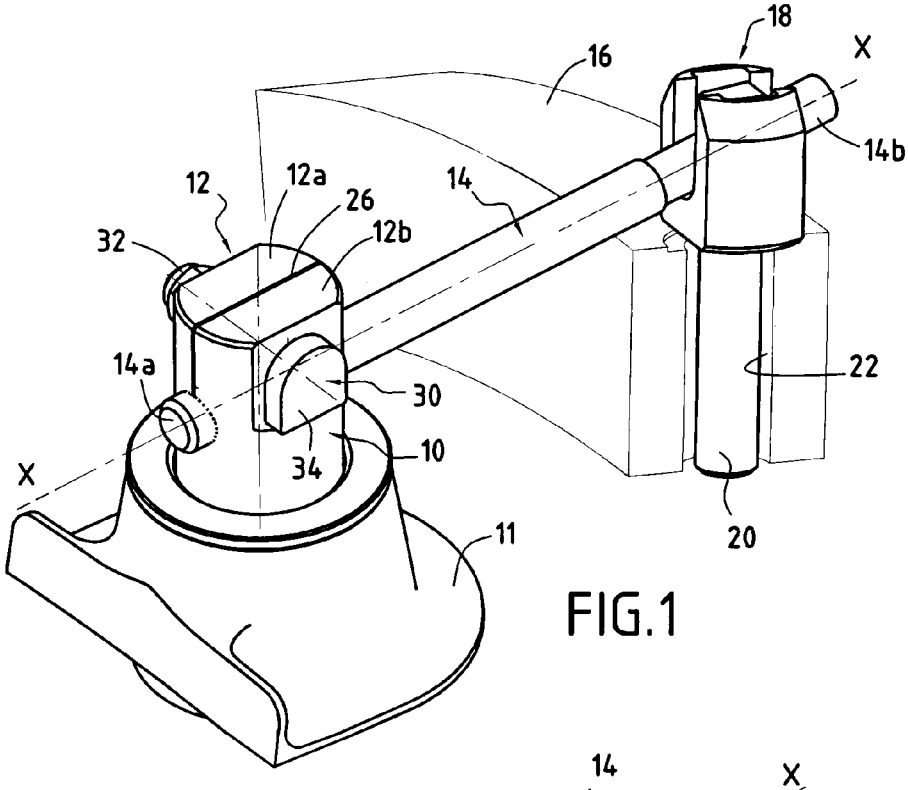
FIG. 1 is a perspective view of a control device constituting an embodiment of the invention.
Figure 2:
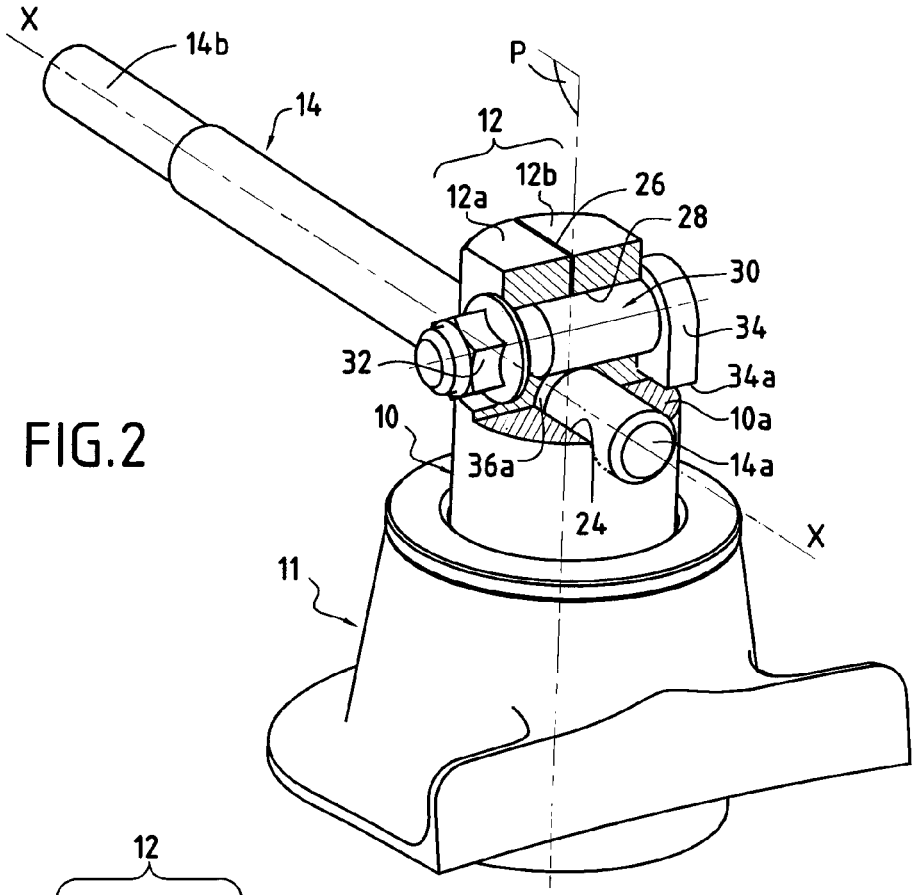
FIG. 2 is a cutaway view of the FIG. 1 device.
Figure 3:
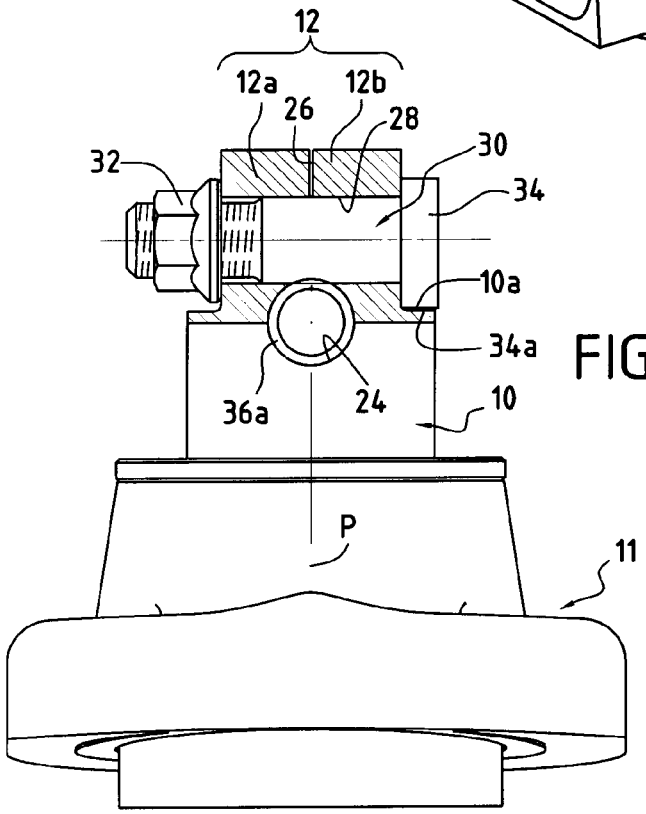
FIG. 3 is a section of FIG. 1.

FIGS. 1 to 3 show a control device constituting an embodiment of the embodiment. Such a device controls a variable-pitch vane, e.g. disposed that the outlet of the low-pressure compressor of a turbomachine.

In conventional manner, a variable-pitch vane is terminated at a radially-outer end (or vane head) by a control pivot 10 (or top pivot), and at a radially-inner end (or blade root) by a guide pivot (or bottom pivot) not shown in the figures.

The control pivot 10 of the vane is generally substantially cylindrical in shape and passes through a stator casing 11 of the turbomachine.

The control pivot 10 is terminated by a head 12 on which there is engaged a first end 14*a* of a control rod 14 having a second end 14*b* that co-operates with a control ring 16 via hinge-forming connection means 18.

For example, the hinge may be made by a pin or finger 20 passing through the second end 14*b* of the rod and engaged in a housing 22 of the control ring 16.

The control ring 16 is centered on the axis of the turbomachine and turning the control ring thereabout serves to turn the control rod 14, thereby simultaneously modifying the orientation of all of the variable-pitch vanes in a given stage of the compressor.

According to the invention, the rod 14 is substantially cylindrical in shape and the first end 14*a* thereof is engaged in a bore 24 of shape corresponding to the rod and passing right through the pivot 10.

Still according to the invention, the device further includes clamping means for clamping the first end 14*a* of the rod 14 in the bore 24 of the pivot 10 so as to fasten it to said pivot.

In the embodiment of FIGS. 1 to 3, the clamping means exert clamping in a direction that is substantially perpendicular to the longitudinal axis X-X of the rod 14.

More precisely, the control device of this embodiment has a slot 26 formed in the pivot 10 of the vane (in its head 12) on a plane P (FIG. 2) that contains the longitudinal axis X-X of the rod 14 and that passes through the middle of the pivot 10. This slot 26 thus splits the head 12 of the pivot 10 into two portions 12*a* and 12*b* that are substantially symmetrical about the plane P.

An orifice 28 of substantially circular right section is also formed through the pivot 10 of the vane (in its head 12) in a direction that is substantially perpendicular to the plane P of the slot 26. Thus, as shown in FIG. 3, the orifice 28 and the bore 24 of the pivot are substantially perpendicular relative to each other.

A screw 30 having a cylindrical body and threaded at its end is mounted in the orifice 28 of the pivot. A clamping nut 32 is screwed onto the threaded end of the screw 30 and bears against one of the portions 12*a* of the head 12 of the pivot, the head 34 of the screw 30 bearing against the other portion 12*b* of the head 12 of the pivot.

By tightening the nut 32, the slot 26 is clamped by the portions 12*a*, 12*b* of the head 12 of the pivot moving towards each other, thereby fastening the first end 14*a* of the rod 14 in the bore 24 of the pivot 10.

According to an advantageous characteristic of the invention, the first end 14*a* of the rod 14 includes an indentation 36*a*, 36*b* for co-operating with the cylindrical portion of the body of the screw 30 when the screw is mounted in the orifice 28 of the pivot 10 of the vane.

The co-operation between the cylindrical portion of the body of the screw 30 and the indentation 36*a*, 36*b* in the rod 14 can be seen more particularly in FIGS. 2 and 3. It provides additional blocking of the rod 14 relative to the pivot, in particular in the event of the nut 32 loosening.

Figure 4B:
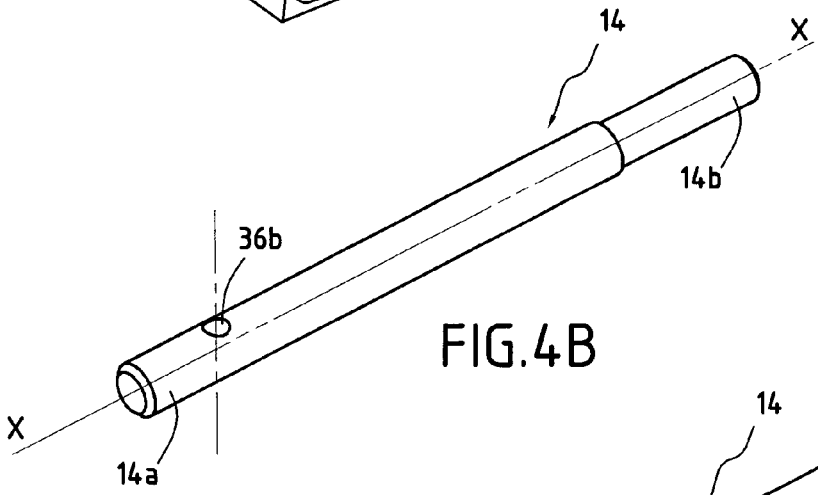
FIGS. 4A and 4B are perspective views of rods of the FIG. 1 device.
Figure 4A:
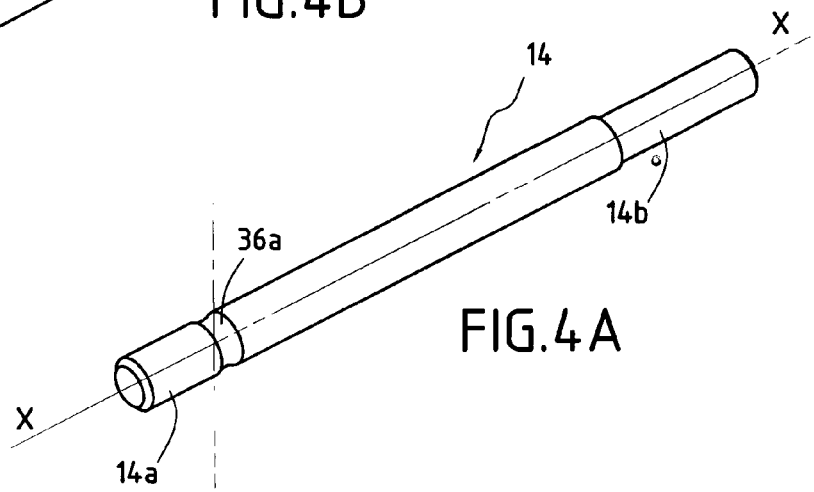

Two embodiments of such an indentation are shown in FIGS. 4A and 4B.

In the example of FIG. 4A, the rod presents an indentation 36*a* that is in the form of an annular groove of substantially circular right section. Such a shape also corresponds to the shape formed in the first end of the rod in FIGS. 2 to 3.

In the example of FIG. 4B, the rod presents an indentation 36*b* that is made in the form of a simple notch of substantially circular right section. This type of indentation requires the rod to be inserted with the right orientation in the bore of the pivot, however compared to an annular groove, it does not reduce the strength of the rod.

According to another advantageous characteristic of the invention, the pivot 10 of the vane presents a shoulder 10*a* that is substantially plane for co-operating with a flat 34*a* of the head 34 of the screw 30 when mounted in the orifice 28 of the pivot 10 of the vane (FIG. 3). As a result, it is possible to prevent the screw 30 from turning in the orifice 28 of the pivot.

FIGS. 5 to 9 show a second embodiment of the invention in which the clamping means exert clamping in a direction that is substantially parallel to the longitudinal axis X-X of the rod 14.

In these figures, the same references are used to designate elements of the control device that are the same as those described above with reference to the first embodiment.

Figure 6:
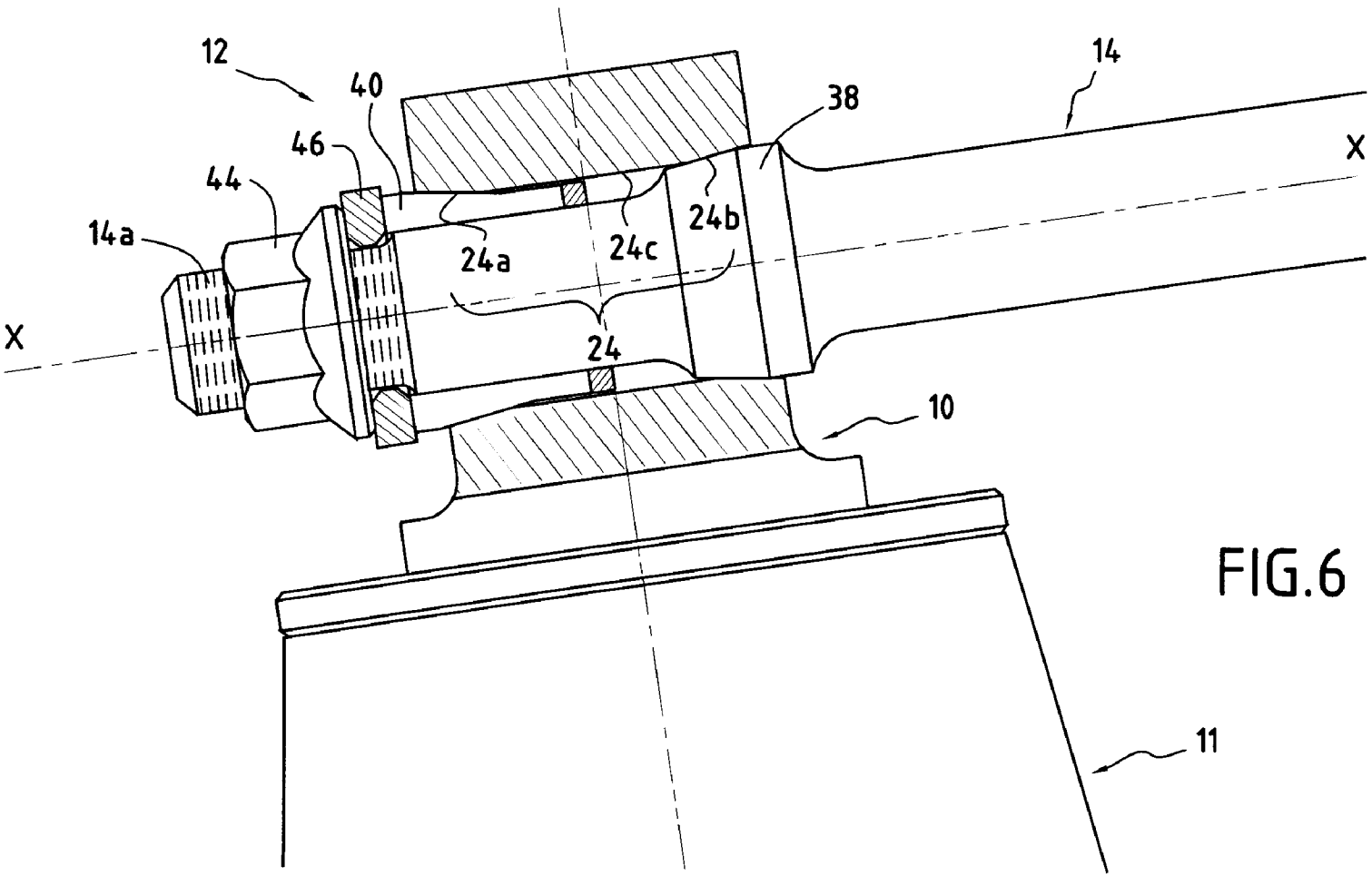
FIG. 6 is a view in section showing a fragment of FIG. 5.
Figure 9:
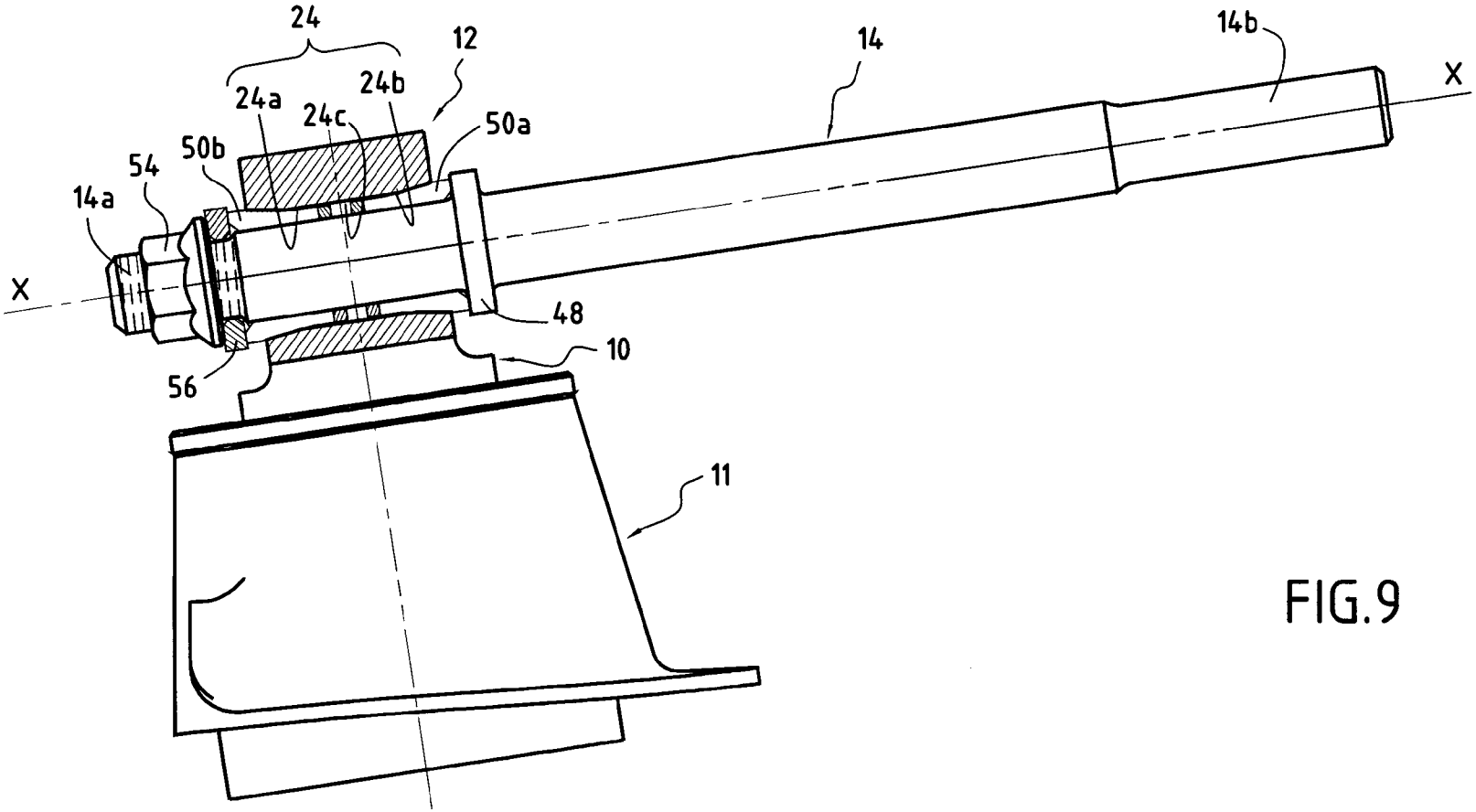
FIG. 9 is a section view of FIG. 7.

In this second embodiment of the invention, the first end 14*a* of the cylindrical rod 14 is threaded, and the bore 24 of the pivot 10 of the vane comprises three portions: two end portions 24*a*, 24*b* that are substantially frustoconical in shape and that open to the outside of the pivot, and a central portion 24*c* that is substantially cylindrical, interconnecting the two end portions 24*a*, 24*b* (FIGS. 6 and 9).

Figure 5:
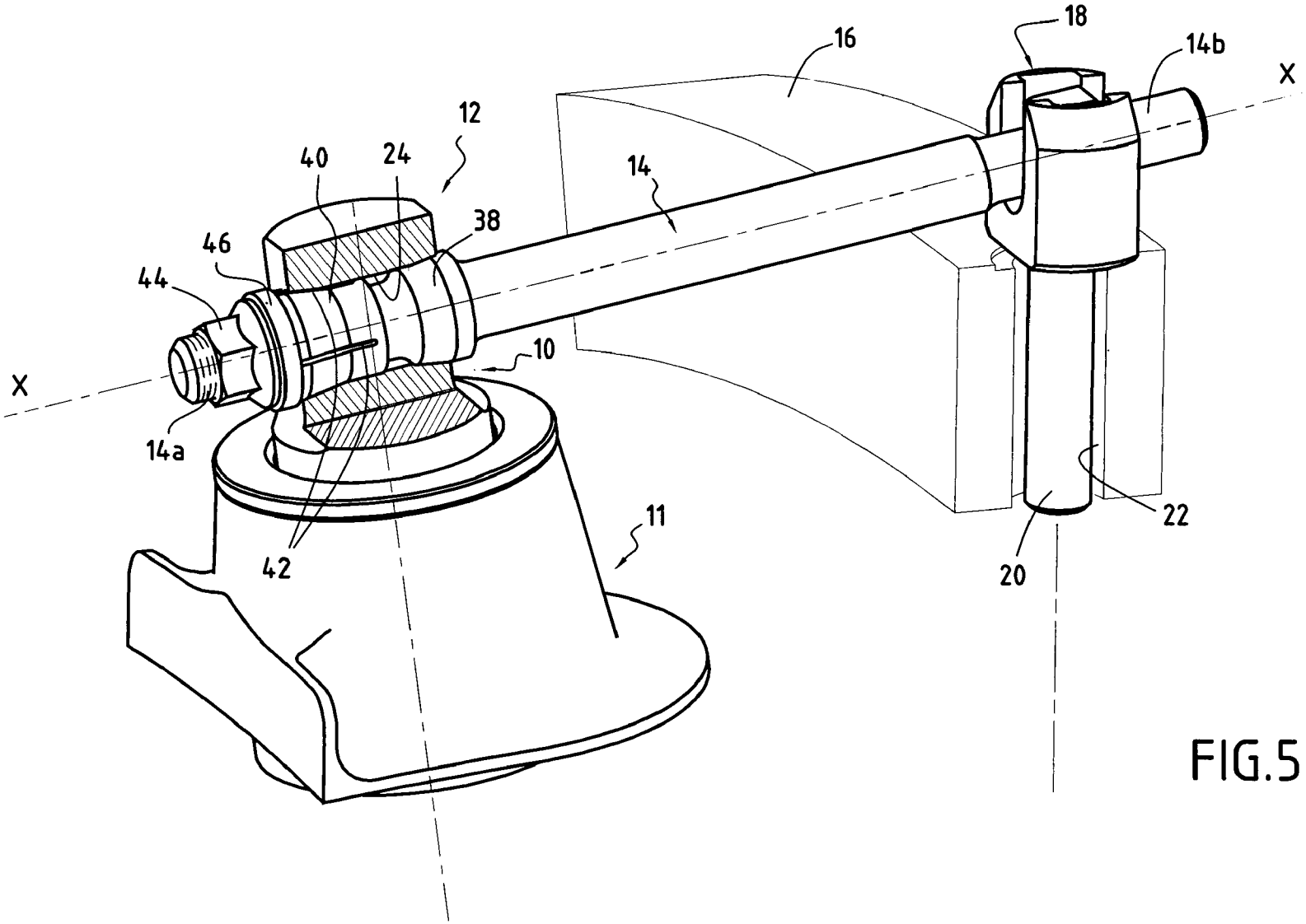
FIG. 5 is a cutaway perspective view of a control device constituting another embodiment of the invention.

In a variant of this second embodiment, shown in FIGS. 5 and 6, the first end 14*a* of the rod 14 also includes a collar 38 having a substantially conical bearing surface that co-operates with one of the end portions 24*b* of the bore 24 in the pivot 10 of the vane.

The control device also includes a clamping part 40 having a portion of substantially frustoconical shape mounted around the first end 14*a* of the rod 14 and co-operating with the other end portion 24*a* of the bore 24 in the pivot 10.

As shown in FIG. 5, the clamping part 40 has slots 42 that extend substantially along the longitudinal axis X-X of the rod when it is mounted in position and that are regularly distributed around its entire circumference.

Furthermore, a clamping nut 44 is screwed onto the threaded portion of the first end 14*a* of the rod 14 and is clamped against the clamping part 40.

By tightening the nut 44, the clamping part 40 tends to move in translation in the bore 24 in the pivot 10, being compressed against itself because of the presence of the longitudinal slots 42. Since the collar 38 of the rod 14 is in abutment in one of the end portions 24*b* of the bore 24 in the pivot 10, this achieves clamping in a direction that is substantially parallel to the longitudinal axis X-X of the rod, thereby securing the first end 14*a* of the rod 14 in the bore 24 of the pivot 10.

As shown in FIGS. 5 and 6, a washer 46 may be interposed between the clamping nut 44 and the clamping part 40 so as to avoid damaging the part when tightening the nut.

Figure 8:
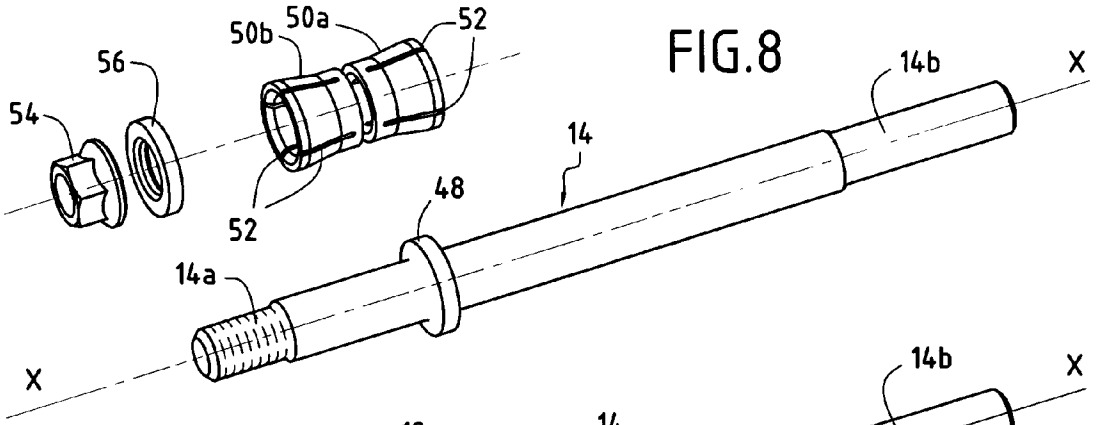
FIG. 8 is a perspective and exploded view of certain elements of the FIG. 7 device.
Figure 7:
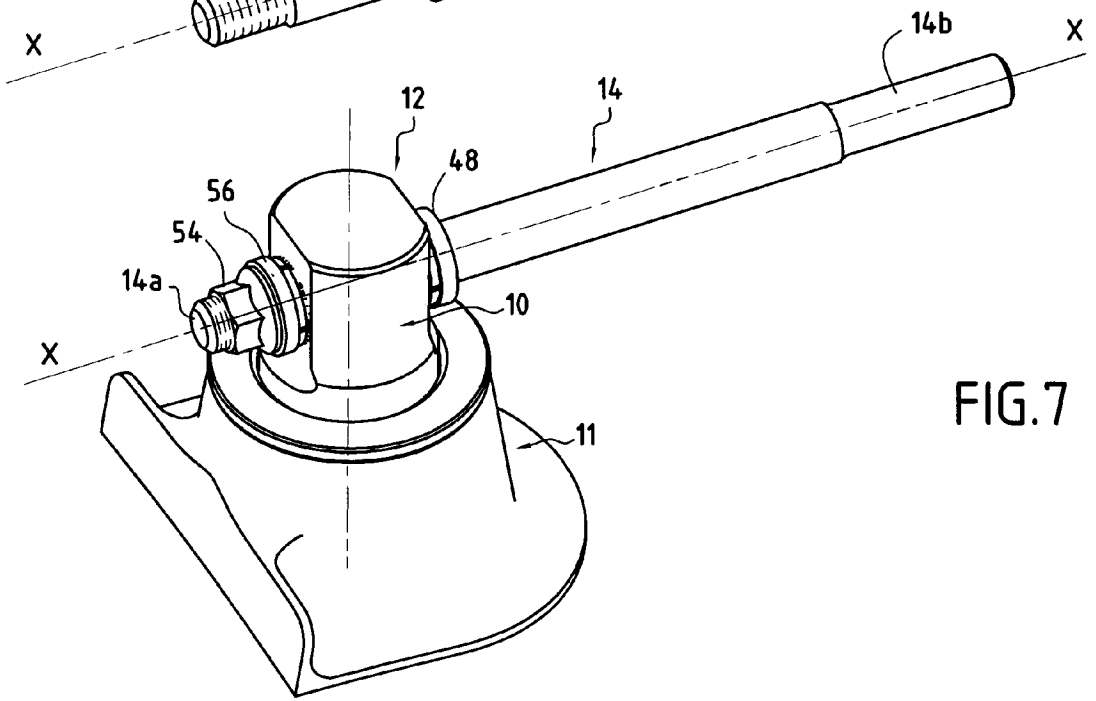
FIG. 7 is a perspective view of a control device constituting yet another embodiment of the invention.

In another variant of this second embodiment, as shown in FIGS. 7 to 9, the first end 14*a* of the rod 14 has a collar 48 forming a longitudinal abutment.

In addition, the control device has first and second clamping parts 50*a*, 50*b*, each having a portion of substantially frustoconical shape and each mounted around the first end 14*a* of the rod 14.

The first clamping part 50*a* co-operates with one of the end portions 24*b* of the bore 24 in the pivot 10 of the vane and comes into abutment against the collar 48 of the rod 14 when the rod is engaged in the bore in the pivot.

The second clamping part 50*b* co-operates with the other end portion 24*a* of the bore 24 in the pivot 10 of the vane when the rod is engaged. As shown in FIG. 8, these clamping parts 50*a*, 50*b* have respective longitudinal slots 52.

Furthermore, a clamping nut 54 is screwed onto the threaded portion of the first end 14*a* of the rod 14 and tightened against the second clamping part 50*b*.

Thus, by tightening the nut 54, the clamping parts 50*a*, 50*b* tend to move towards each other, being compressed on themselves because of the presence of the longitudinal slots 52. As a result, clamping is achieved in a direction that is substantially parallel to the longitudinal axis X-X of the rod, thus enabling the first end 14*a* of the rod 14 to be fastened in the bore 24 in the pivot 10.

As in the other variant of this embodiment, it is possible to interpose a washer 56 between the clamping nut 54 and the second clamping part 50*b* so as to avoid damaging it when tightening the nut.

It should be observed that the clamping parts 40, 50*a*, 50*b* of both variants of this second embodiment are substantially identical in shape.

What is claimed is:

1. A device for controlling a variable-pitch vane for a turbomachine compressor, the device comprising:

a rod which is substantially cylindrical in shape;

means for fastening a first end of the rod on a pivot of a vane to be controlled, the first end of the rod being engaged in a bore in the pivot of the vane;

connection means between a second end of the rod and a control ring; and clamping means for clamping the first end of the rod in the bore in the pivot in order to fasten the rod to the pivot, the clamping means exerting clamping in a direction that is substantially perpendicular to the longitudinal axis of the rod, wherein a slot is formed in a head of the pivot of the vane in a plane containing the longitudinal axis of the rod and lies in the middle of the pivot such that the head is split into two portions which are substantially symmetrical about the plane, an orifice is formed through the head of the pivot of the vane in a direction substantially perpendicular to the plane of the slot, and a screw is mounted in the orifice of the pivot and clamped by a clamping nut so as to clamp said slot, and wherein a cylindrical portion of the body of the screw abuts the first end of the rod when the screw is mounted in the orifice in the pivot of the vane.

2. A device according to claim 1, wherein the first end of the rod includes an indentation which abuts the cylindrical portion of the body of the screw when the screw is mounted in the orifice in the pivot of the vane so as to provide additional blocking of the rod on the pivot.

3. A device according to claim 1, wherein the pivot of the vane presents a substantially plane shoulder which abuts a flat of a head of the screw when the screw is mounted in the orifice in the pivot of the vane so as to prevent the screw from turning in the orifice in the pivot.

4. A device for controlling a variable-pitch vane for a turbomachine compressor, the device comprising:

a rod which is substantially cylindrical in shape;

means for fastening a first end of the rod on a pivot of a vane to be controlled, the first end of the rod being engaged in a bore in the pivot of the vane;

connection means between a second end of the rod and a control ring; and clamping means for clamping the first end of the rod in the bore in the pivot in order to fasten the rod to the pivot, the clamping means exerting clamping in a direction that is substantially parallel to the longitudinal axis of the rod, wherein the first end of the rod is threaded and the bore in the pivot of the vane presents first and second end portions that are substantially frustoconical in shape opening to the outside of the pivot, the end portions being interconnected by a substantially cylindrical central portion, wherein the first end of the rod includes a collar having a conical bearing surface co-operating with the first end portion of the bore in the pivot of the vane, and wherein the device further comprises:

a clamping part of substantially frustoconical shape mounted around the first end of the rod and disposed inside and abutting the second end portion of the bore in the pivot, said clamping part having longitudinal slots; and a clamping nut screwed onto the first end of the rod and tightened against the clamping part.

5. A device for controlling a variable-pitch vane for a turbomachine compressor, the device comprising:

a rod which is substantially cylindrical in shape;

means for fastening a first end of the rod on a pivot of a vane to be controlled, the first end of the rod being engaged in a bore in the pivot of the vane;

connection means between a second end of the rod and a control ring; and clamping means for clamping the first end of the rod in the bore in the pivot in order to fasten the rod to the pivot, the clamping means exerting clamping in a direction that is substantially parallel to the longitudinal axis of the rod, wherein the first end of the rod is threaded and the bore in the pivot of the vane presents first and second end portions that are substantially frustoconical in shape opening to the outside of the pivot, the end portions being interconnected by a substantially cylindrical central portion, wherein the first end of the rod includes a collar forming a longitudinal abutment, and wherein the device further comprises:

a first clamping part of substantially frustoconical shape mounted around the first end of the rod in abutment against the collar and co-operating with the first end portion of the bore in the pivot of the vane;

a second clamping part of substantially frustoconical shape mounted around the first end of the rod and co-operating with the second end portion of the bore in the pivot of the vane, the clamping parts each having longitudinal slots; and a clamping nut screwed onto the first end of the rod and tightened against the second clamping part.

6. A turbomachine compressor including at least one variable-pitch vane control device according to claim 1.

7. A turbomachine including at least one variable-pitch control device according to claim 1.

8. A device according to claim 2, wherein the indentation is an annular groove of substantially circular right section.

9. A device according to claim 2, wherein the indentation is a notch of substantially circular right section.

10. A turbomachine compressor including at least one variable-pitch vane control device according to claim 4.

11. A turbomachine including at least one variable-pitch control device according to claim 4.

12. A turbomachine compressor including at least one variable-pitch vane control device according to claim 5.

13. A turbomachine including at least one variable-pitch control device according to claim 5.

* * * * *